US012122579B2

(12) United States Patent
Rustad et al.

(10) Patent No.: US 12,122,579 B2
(45) Date of Patent: Oct. 22, 2024

(54) CONTAINER CARRIER

(71) Applicant: ILLINOIS TOOL WORKS INC., Glenview, IL (US)

(72) Inventors: Griffin E. Rustad, Chicago, IL (US); Christopher J. Samaras, Tinley Park, IL (US); Hyunchul Kim, Chicago, IL (US); Jacob M. Fornof, Chicago, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/981,081

(22) Filed: Nov. 4, 2022

(65) Prior Publication Data

US 2023/0145290 A1 May 11, 2023

Related U.S. Application Data

(60) Provisional application No. 63/276,280, filed on Nov. 5, 2021, provisional application No. 63/348,612, filed on Jun. 3, 2022.

(51) Int. Cl.
*B65D 71/50* (2006.01)

(52) U.S. Cl.
CPC ..... *B65D 71/50* (2013.01)

(58) Field of Classification Search
CPC ..... B65D 71/50; B65D 71/504; B65D 71/40
USPC ..... 206/151, 145, 147, 148, 158
See application file for complete search history.

(56) References Cited

U.S. PATENT DOCUMENTS 5,188,413 A * 2/1993 Nathan ..... B65D 71/50 206/199
5,735,562 A 4/1998 Borg
6,394,517 B1 5/2002 Borg
6,715,810 B2 4/2004 Borg
7,108,128 B2 9/2006 Borg
7,147,100 B1 12/2006 Borg
7,377,382 B2 5/2008 Borg et al.
7,588,275 B2 9/2009 Borg
(Continued)

FOREIGN PATENT DOCUMENTS

DE 10 2018 005 250 A1 1/2020
EP 1970323 9/2008
(Continued)

OTHER PUBLICATIONS

ISA/EP, English language verison of the International Search Report, Form PCT/ISA/210, for International Application PCT/US2022/049124, Nov. 7, 2021 (10 pages).
(Continued)

*Primary Examiner* — Steven A. Reynolds
(74) *Attorney, Agent, or Firm* — Pauley Erickson & Swanson

(57) ABSTRACT

A container carrier for unitizing a plurality of containers includes a network of molded ribs forming a plurality of container receiving openings formed in a first plane and a plurality of radial tabs positioned within each container receiving opening. A plurality of raised rings are each formed over each container receiving opening and formed in a second plane. A band may be formed over each raised ring in the second plane and a rail may be positioned on an underside of the container carrier between each pair of container receiving openings.

15 Claims, 7 Drawing Sheets

(56) References Cited

U.S. PATENT DOCUMENTS

| | | | | |
|---|---|---|---|---|
| 7,823,943 | B2 | 11/2010 | Borg | |
| D705,666 | S | 5/2014 | Borg | |
| D721,598 | S | 1/2015 | Borg | |
| D722,891 | S | 2/2015 | Borg et al. | |
| D757,548 | S * | 5/2016 | Borg | D9/434 |
| 9,517,859 | B2 | 12/2016 | Borg et al. | |
| D831,501 | S * | 10/2018 | Borg | D9/752 |
| 10,266,326 | B2 | 4/2019 | Borg et al. | |
| 10,293,998 | B2 | 5/2019 | Borg et al. | |
| 10,364,080 | B2 * | 7/2019 | Tetreault | B65D 71/50 |
| 10,399,742 | B2 | 9/2019 | Borg et al. | |
| 10,892,283 | B2 | 1/2021 | Zhang et al. | |
| 11,001,428 | B2 | 5/2021 | Borg et al. | |
| 2005/0133386 | A1 * | 6/2005 | Wong | B65D 71/50 206/139 |
| 2007/0296231 | A1 | 12/2007 | Borg | |
| 2012/0073997 | A1 | 3/2012 | Borg | |
| 2018/0251261 | A1 * | 9/2018 | Borg | B65D 71/00 |
| 2019/0329951 | A1 * | 10/2019 | Borg | B65D 71/504 |
| 2021/0245940 | A1 * | 8/2021 | Borg | B65D 21/0224 |

FOREIGN PATENT DOCUMENTS

| | | |
|---|---|---|
| EP | 3369675 | 9/2018 |
| FR | 1 221 954 A | 6/1960 |
| WO | WO 95/08488 A1 | 3/1995 |
| WO | WO2020/160416 | 8/2020 |

OTHER PUBLICATIONS

ISA/EP, Form PCT/ISA/237, Written Opinion of the International Searching Authority, for International Application PCT/US2022/049124, Nov. 7, 2021 (14 pages).

* cited by examiner

CONTAINER CARRIER

CROSS-REFERENCE TO RELATED APPLICATIONS

This application claims priority to U.S. Provisional Application, Ser. Nos. 63/276,280, filed on 5 Nov. 2021 and 63/348,612, filed on 3 Jun. 2022. These U.S. Provisional Applications are hereby incorporated by reference herein in their entirety and are made a part hereof, including but not limited to those portions which specifically appear hereinafter.

BACKGROUND OF THE INVENTION

Field of the Invention

This invention relates generally to beverage multipacks and, more particularly, to multipacks made up of a plurality of containers.

Description of Prior Art

Conventional container carriers are often used to unitize a plurality of similarly sized containers, such as cans, bottles, jars and boxes and/or similar containers that require unitization. Flexible plastic ring carriers and paperboard boxes are two such conventional container carriers.

However, with growing concerns surrounding the environmental impact of improper disposal of plastic waste, manufacturers are transitioning offerings to best support a circular economy. One such solution is plastic ring carriers made from 50% post-consumer recycled content. This carrier is operationally efficient, competitively priced, simple, and has a low carbon footprint in comparison to other beverage multipack alternatives. Today, this flexible solution is not considered 100% curbside recyclable by the FTC Green Guide because 60%+ consumers cannot recycle flexible plastics. Multi-packaging systems are generally used in the beer, soft drink, and general products industries. A new and innovative beverage multipacking solution is desirable that includes a 4, 6, 8, and/or 12 beverage capacity. A preferred design is produced using 100% curbside recyclable rigid plastics, like HDPE or PET. These carriers would be applied on PET bottles and/or aluminum cans.

SUMMARY OF THE INVENTION

The invention generally relates to a container carrier for unitizing a plurality of containers into a multipack.

A preferred embodiment of the subject invention is made from materials that are 100% curbside recyclable, in particular rigid PET and HDPE plastics that can enter most municipal recycling streams. This invention focuses on end-user needs and structural plastics that can easily be recycled. A solution that is meaningful, practical and makes a positive impact to encourage people to recycle is desired.

Other objects and advantages will be apparent to those skilled in the art from the following detailed description taken in conjunction with the appended claims and drawings.

DETAILED DESCRIPTION OF THE INVENTION

Figure 1:
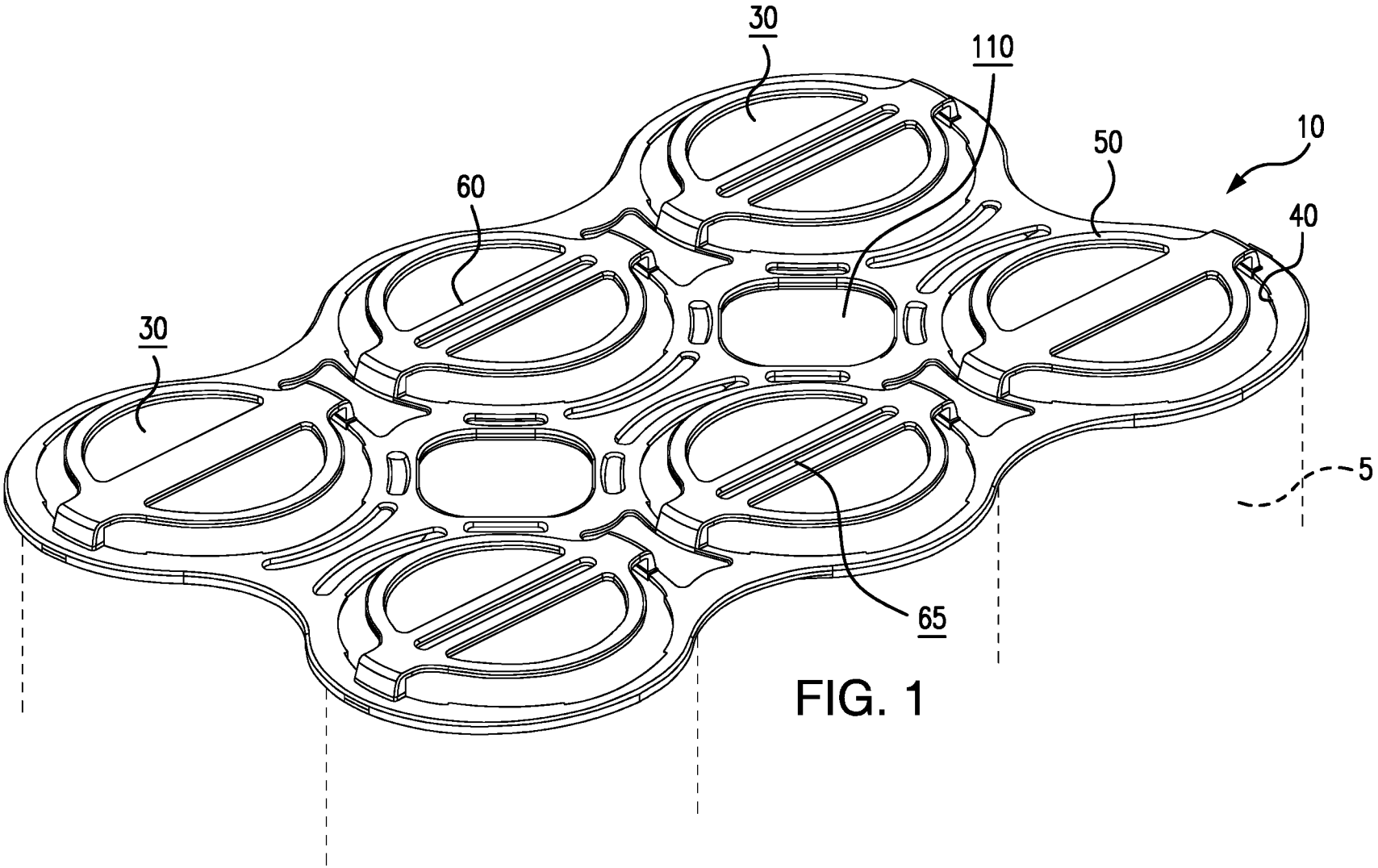
FIG. 1 shows a perspective view of a container carrier according to one embodiment of the invention.

The present invention provides a container carrier to unitize a plurality of containers into beverage multipacks. The container carrier according to this invention is shown in FIGS. 1-9. FIG. 1 includes phantom lines showing where containers 5 would be positioned within a unitized multipack and FIG. 9 shows a completed multipack featuring a unitized plurality of six containers.

According to a preferred embodiment of this invention, the container carrier 10 is injection molded or otherwise formed from high density polyethylene (HDPE). Alternatively, PET or HDPE plastics may be used. Preferably, the material is generally rigid and 100% post-consumer recyclable in most or all markets.

Once manufactured, the container carrier 10 may be applied to groups of containers 5 to make completed unitized multipacks. Although much of the disclosure shows and describes six pack multipacks, it is further contemplated that 4 packs, 8 packs, 10 packs and 12 packs may be unitized without departing from the essential features of this invention.

In a preferred embodiment of this invention, shown in FIGS. 1-5, the container carrier 10 includes a network of molded ribs 20 forming a plurality of container receiving openings 30 corresponding with a desired size of multipack. As such, although FIGS. 1-4 show six container receiving openings in a 2×3 array, other desired container carriers may be 2×2 for a four pack, 2×4 for an eight pack, or other desired arrays forming a desirable quantity multipack size.

The plurality of container receiving openings 30 are preferably formed in a first plane 35. Although the container carrier 10 described includes some thickness, the thickness is generally negligible compared to a footprint of the container carrier 10.

The container receiving openings 30 are each preferably generally circular but include a plurality of radial tabs 40 positioned within each container receiving opening 30. The container receiving openings 30 and the respective integrated radial tabs 40 are preferably all formed in a single, first plane 35.

As such, the container receiving opening 30 comprises one diameter while the plurality of radial tabs 40 together comprise a slightly smaller diameter thereby permitting engagement with a chime of a container 5, preferably a traditional aluminum can. In this manner, a container may be snapped into place within the respective container receiving aperture 30 such that the radial tabs 40 engage directly with the chime while the remainder of the container receiving aperture 30 simply encircles the chime.

Figure 2:
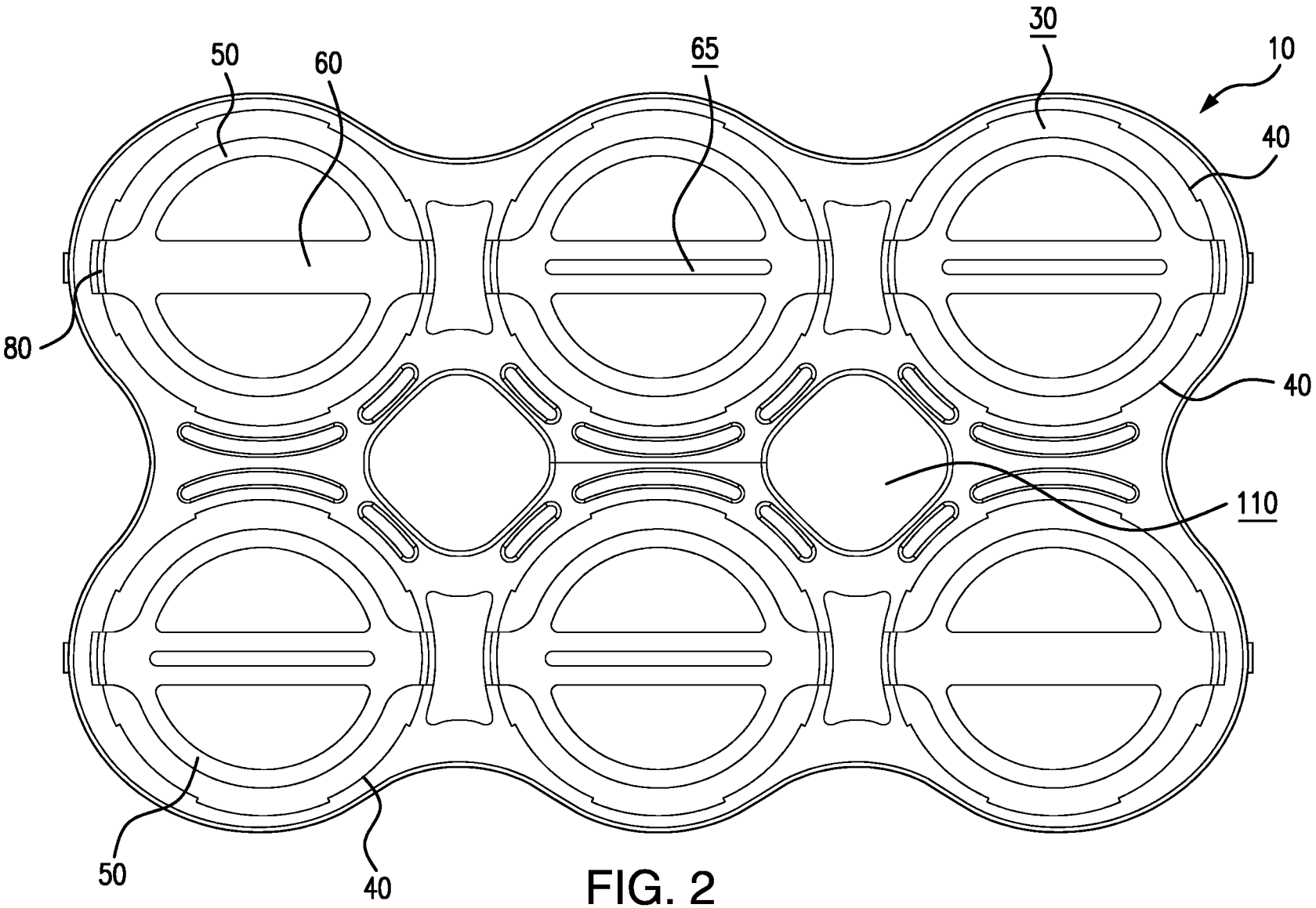
FIG. 2 shows a top plan view of a container carrier according to one embodiment of the invention.
Figure 3:
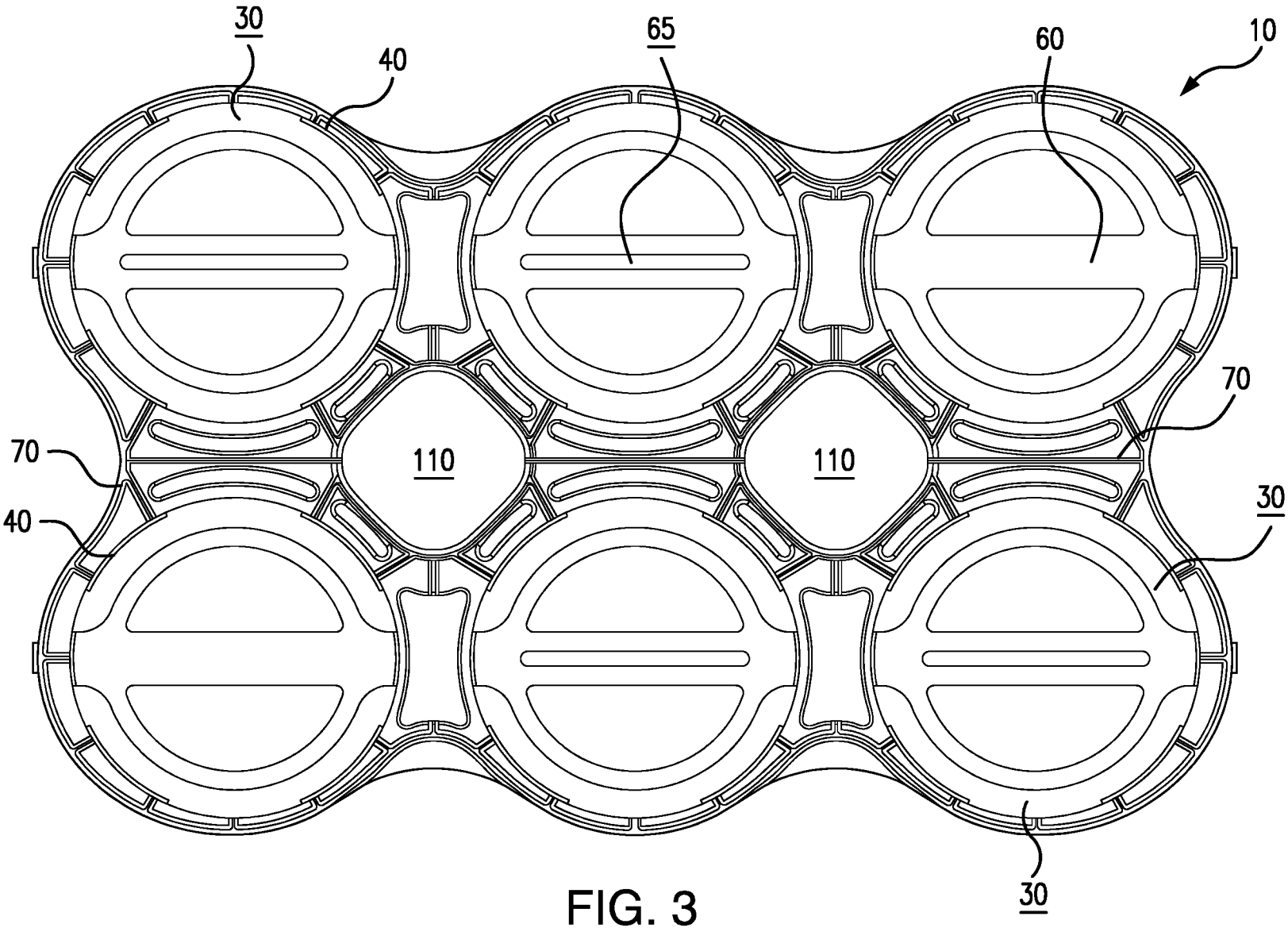
FIG. 3 shows a bottom plan view of a container carrier according to one embodiment of the invention.

The radial tabs 40 may be formed equidistantly around the perimeter of each container receiving opening 30, such as shown in FIG. 2. Further, the radial tabs 40 are preferably offset from longitudinal and transverse axes of the container carrier 10. As such, the radial tabs 40 in one embodiment are generally positioned at 2, 4, 8, and 10 o'clock presuming 12 o'clock is a top of FIG. 2. As described above, the radial tabs 40 preferably comprise two or more radial segments of the container receiving opening 30 that include a smaller diameter than the respective container receiving opening 30.

As shown in the figures, the container carrier 10 preferably further includes a plurality of raised rings 50. Each raised ring 50 is preferably formed relative to a respective container receiving opening 30. As such, one raised ring 50 formed over one container receiving opening 30. The raised rings 50 are preferably formed in a second plane 55.

The raised rings 50 are preferably generally circular and configured in a slightly smaller diameter than the respective container receiving opening. A pair of risers 80 are preferably formed at each longitudinal extremity of the respective raised ring 50 to connect the ribs 20 surround each container receiving opening 30 with the respective raised ring 50.

A band 60 is preferably formed over each raised ring 50 in the second plane 65. The band 60 may include marketing graphics regarding the respective product, pricing information, recyclability information and/or other printed subject matter. One or more bands 60 may further include a central recess 65 extending across the band 60 and a respective raised ring 50. The bands 60 may additionally prevent cans in the respective multipack from accidentally opening or "venting" when stacked and removed. Further the bands 60 may act to minimize larger openings in the container carrier 10 to prevent entrapment by wildlife or entanglement with comingled recyclables.

Figure 4:
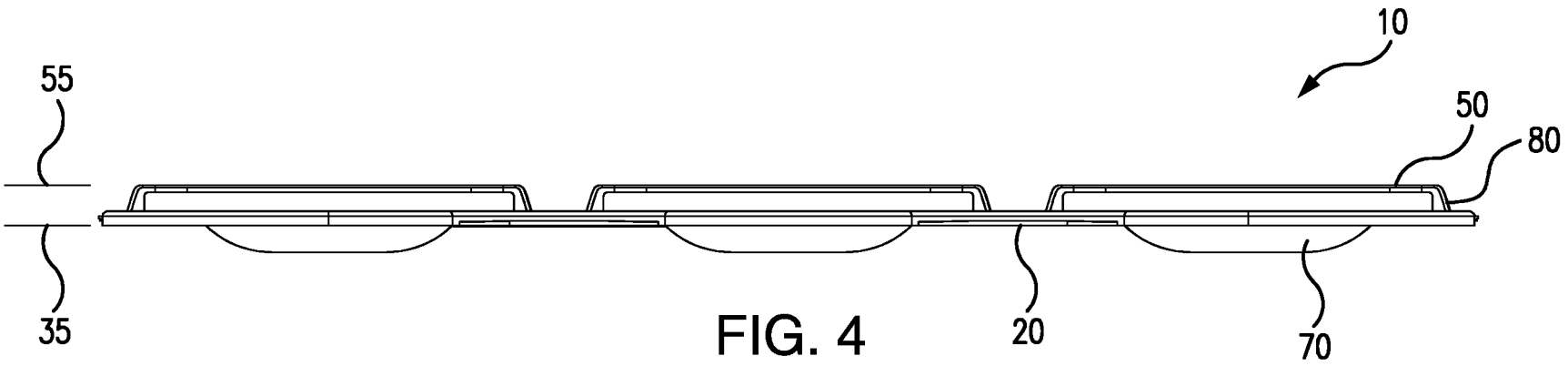
FIG. 4 shows a side view of a container carrier according to one embodiment of the invention.

As best shown in FIG. 4, the container carrier 10 may further include a rail 70 positioned on an underside of the container carrier 10 between each transverse pair of container receiving openings 30. The rail 70 is preferably fairly narrow and includes a smooth profile that extends downwardly from the first plane 35. The rail 70 preferably extends downwardly a same or similar distance as the raised rings 50 are elevated over the container receiving openings 30. For instance, a height of the risers 80 may be approximate to a depth of the rail 70. In this manner, the container carriers 10 may be stackable but also are easily and smoothly disengageable from the stack for application to containers and handling.

Figure 5:
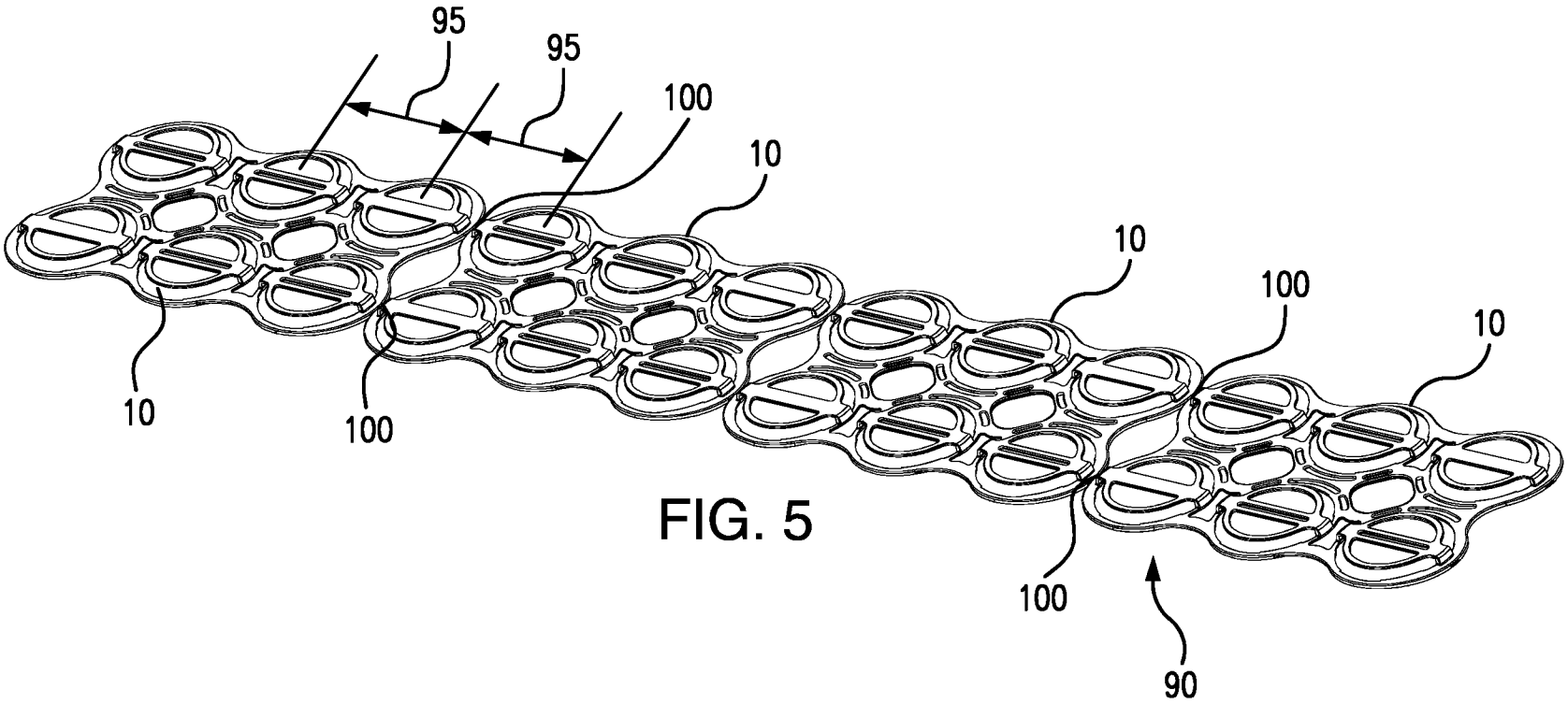
FIG. 5 shows a stick of multiple container carriers according to one embodiment of the invention.

As shown in FIG. 5, the container carrier 10 may be grouped in segments or "sticks" 90 of two to four container carriers 10 connected in a unitized stick 90 that includes frangible connection points 100 between adjacent container carriers 10. For ease of application to containers and handling of bulk container carriers 10, a pitch 95, or longitudinal distance, between adjacent container receiving openings 30 is constant throughout the stick 90. As such, the pitch 95 between container receiving openings 30 within a single container carrier 10 is the same as the pitch 95 between edge container receiving openings 30 that are joined at connection points 100 within the stick 90.

A finger hold 110 is preferably formed between each four of the container receiving openings 30 to provide an opening for grasping the multipack. As such, in a six-pack arrangement, a pair of finger holds 110 are formed between six container receiving openings 30. As shown in the figures, these finger holds may be rhombus shaped having generally rounded corners.

Figure 6:
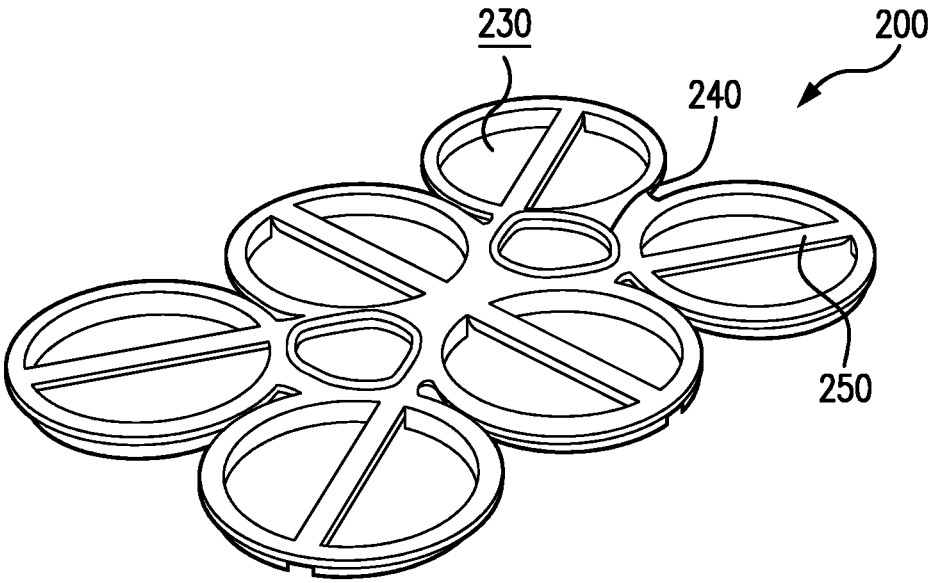
FIG. 6 shows a perspective view of a container carrier according to one embodiment of the invention.
Figure 7:
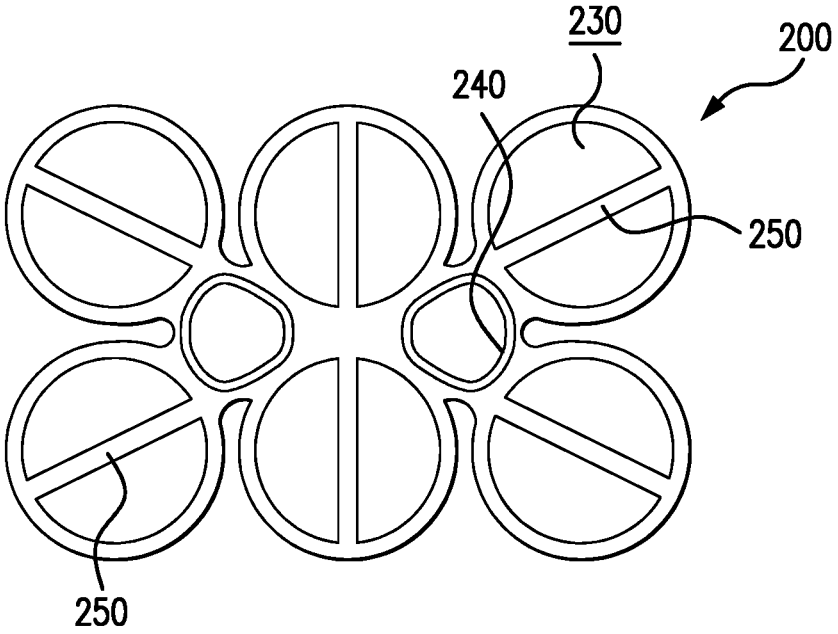
FIG. 7 shows a top plan view of a container carrier according to one embodiment of the invention.
Figure 8:
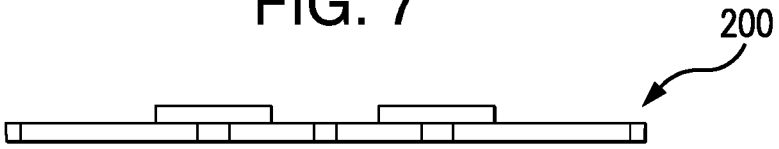
FIG. 8 shows a side view of a container carrier according to one embodiment of the invention.
Figure 9:
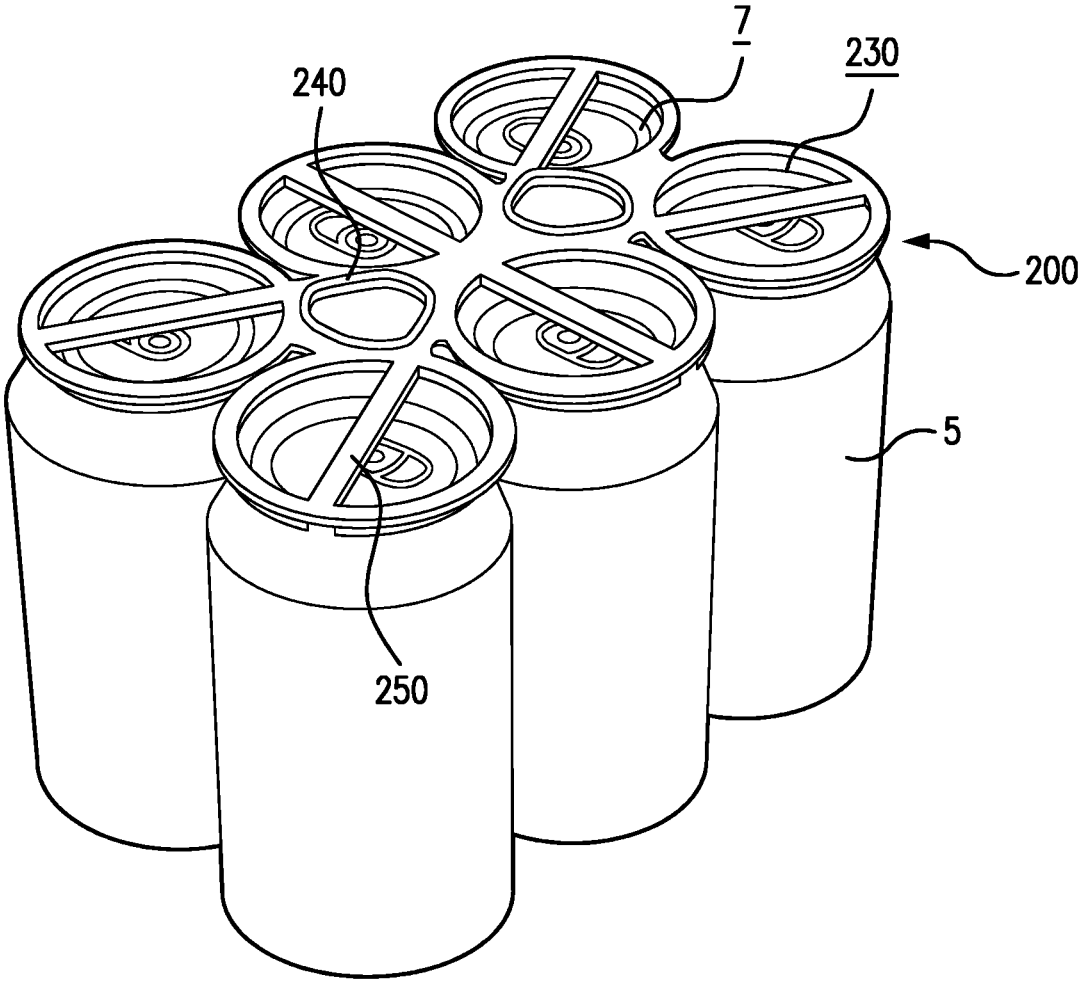
FIG. 9 shows a perspective view of a multipackage formed by a container carrier according to one embodiment of the invention.

FIGS. 6-9 show another embodiment of a container carrier 200. As best shown in FIGS. 6 and 8, the container carrier 200 preferably includes a contoured thickness 220 around a perimeter of each container receiving opening 230. In this way, the container receiving opening 230 may engage with a chime 7 of the container 5 to retain the container 5 within the multipack.

A pair of fingerholds 240 are preferably formed within the container carrier 200. Likewise, these fingerholds 240 preferably form a contoured thickness for ease of carrying the multipack.

A series of struts 250 are additionally formed through the container carrier 200. These struts 250 preferably extend from corner to corner of the container carrier 200 and transversely across a central area of the container carrier 200. These struts 250 provide stability to the multipackage while also discouraging accidentally opening of can tabs when multipackages are handled or stacked.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A container carrier for unitizing a plurality of containers, the container carrier comprising:

a network of molded ribs forming a plurality of container receiving openings formed in a first plane;

a plurality of radial tabs positioned within each container receiving opening;

a plurality of raised rings, one raised ring formed over each container receiving opening, the raised rings formed in a second plane;

a pair of risers formed between each container receiving opening and raised ring; and a plurality of bands, each band of the plurality of bands formed across each raised ring in the second plane, wherein the bands and the risers together comprise a generally common width, wherein two or more bands of the plurality of bands include a central recess extending across a respective raised ring.

2. The container carrier of claim 1 further comprising a rail positioned on an underside of the container carrier between each pair of container receiving openings, the rail extending downwardly from the first plane.

3. The container carrier of claim 2 wherein the rail extends downwardly a similar distance as the raised rings are elevated over the container receiving openings.

4. The container carrier of claim 1 wherein the radial tabs are formed equidistantly around a perimeter of each container receiving opening.

5. The container carrier of claim 4 wherein the radial tabs are offset from longitudinal and transverse axes of the container carrier.

6. The container carrier of claim 1 wherein the radial tabs comprise two or more radial segments of the container receiving opening that include a smaller diameter than the container receiving opening.

7. The container carrier of claim 1 comprising two to four container carriers connected in a unitized stick that includes frangible connection points between adjacent container carriers.

8. The container carrier of claim 7 wherein a pitch between adjacent container receiving openings is constant throughout the stick.

9. The container carrier of claim 1 wherein the container receiving opening and the radial tabs are all formed in the first plane.

10. The container carrier of claim 1 wherein each raised ring is generally circular and comprises a smaller diameter than a respective container receiving opening.

11. A container carrier for unitizing a plurality of containers, the container carrier comprising:

a network of molded ribs forming a plurality of container receiving openings formed in a first plane;

a plurality of radial tabs positioned within each container receiving opening in the first plane;

a plurality of raised rings, one raised ring formed over each container receiving opening, the raised rings formed in a second plane;

a band formed across each raised ring in the second plane;

a pair of risers formed between each container receiving opening and raised ring, wherein the bands and the risers together comprise a generally common width; and a rail positioned on an underside of the container carrier between each pair of container receiving openings, the rail extending downwardly from the first plane, wherein the rail extends downwardly a similar distance as the raised rings are elevated over the container receiving openings.

12. The container carrier of claim 11 wherein the band includes a central recess extending across a respective raised ring.

13. A container carrier for unitizing a plurality of containers, the container carrier comprising:

a network of molded ribs forming a plurality of container receiving openings formed in a first plane;

a plurality of radial tabs positioned within each container receiving opening;

a plurality of raised rings, one raised ring formed over each container receiving opening, the raised rings formed in a second plane;

exactly two risers formed between each container receiving opening and raised ring, the two risers aligned in a longitudinal direction of the container carrier; and a plurality of bands, each band of the plurality of bands formed across each raised ring in the second plane, wherein the bands and the risers together comprise a generally common width.

14. The container carrier of claim 13 wherein two or more bands of the plurality of bands include a central recess extending across a respective raised ring.

15. A container carrier for unitizing a plurality of containers, the container carrier comprising:

a network of molded ribs forming a plurality of container receiving openings formed in a first plane;

a plurality of radial tabs positioned within each container receiving opening;

a plurality of raised rings, one raised ring formed over each container receiving opening, the raised rings formed in a second plane;

a pair of risers formed between each container receiving opening and raised ring;

a rail positioned on an underside of the container carrier between each pair of container receiving openings, the rail extending downwardly from the first plane, wherein the rail extends downwardly a similar distance as the raised rings are elevated over the container receiving openings; and a plurality of bands, each band of the plurality of bands formed across each raised ring in the second plane, wherein the bands and the risers together comprise a generally common width.

* * * * *